United States Patent [19]

Chan

[11] Patent Number: 4,652,047

[45] Date of Patent: Mar. 24, 1987

[54] FOLDING CHAIRS

[76] Inventor: Alexander Guy Chan, 136 Turquoise Way, San Francisco, Calif. 94131

[21] Appl. No.: 622,105

[22] Filed: Jun. 19, 1984

[51] Int. Cl.[4] ..... A47C 4/28

[52] U.S. Cl. ..... 297/45; 248/431; 297/56

[58] Field of Search ..... 297/45, 57, 56; 248/431; D6/368

[56] References Cited

U.S. PATENT DOCUMENTS

| | | | |
|---|---|---|---|
| 1,241,987 | 10/1917 | Kalisz | 248/431 |
| 2,702,586 | 2/1955 | Borgfeldt | 297/45 X |
| 3,124,387 | 3/1964 | Maclaren | 297/16 |
| 3,312,501 | 12/1965 | Penn | 297/42 |
| 3,635,530 | 2/1970 | Roher | 297/45 |
| 3,838,883 | 10/1973 | Machen | 297/45 |
| 4,065,173 | 12/1977 | Gittings | 297/45 |
| 4,184,711 | 8/1977 | Wakimoto | 297/16 |

FOREIGN PATENT DOCUMENTS

| | | | |
|---|---|---|---|
| 2315240 | 1/1977 | France | 297/45 |

*Primary Examiner*—James T. McCall

[57] ABSTRACT

A folding chair provided with 8 rods, 4 of which stand vertically a distance apart defining the four corners of the chair and four of which are diagonally crossed and pivotly secured to each other near their midpoints. The lower end of each diagonal rod is connected to the lower portion of a vertical rod and the upper end of the diagonal rod is connected to the upper portion of the vertical rod located at the corner diagonally opposite the first vertical rod. A seat bottom comprised of flexible material and two bracing rods is supported at four corners where the upper ends of the diagonal rods meet the vertical rods. Arm and back supports of a flexible material are supported by portions of the vertical rods extending upward beyond the seat level. Each vertical rod is connected to a diagonal rod in two locations. In the first embodiment, one connection is a releasable joint and the other connection is pivoted joint. In the second embodiment, two pivoted joints on each vertical rod are allowed to move towards and away from each other by means of an expanding and contracting rod. Both of these constructions permit the chair to be collapsed into a compact linear storage configuration in which the diagonally crossed rods pivot into a position alongside one another while the vertical rods assume a position alongside the diagonal rods.

10 Claims, 16 Drawing Figures

FOLDING CHAIRS

The present invention relates to folding chairs of a general type which use diagonally crossed rods to support a seat and fold into a linear storage package with rods lying alongside one another. Chairs of this type have incorporated arm and back rests (Wakimoto, U.S. Pat. No. 4,184,711; Roher, U.S. Pat. No. 3,635,520; Penn, U.S. Pat. No. 3,312,501) but none provide vertical rods braced with diagonal rods forming a triangulated chair structure with only eight rods capable of supporting a seat, a backrest and armrests.

SUMMARY OF THE INVENTION

The present invention provides for a folding chair structure including 8 rods, 4 of which stand upright, hereafter referred to as vertically a distance apart defining the four corners of the chair, and four of which are diagonally crossed and pivotly secured to each other near their midpoints. The lower end of each diagonal rod is connected to the lower portion of a vertical rod and the upper end of the diagonal rod is connected to the upper portion of the vertical rod located at the corner diagonally opposite the first vertical rod. A seat bottom of flexible material incorporating a bracing rod at either side of the seat is supported at four corners where the upper ends of the diagonal rods meet the vertical rods. Arm and back supports of a flexible material are supported by portions of the vertical rods extending upward beyond the seat level. Each vertical rod is connected to a diagonal rod in two locations. In the first embodiment, one connection is a releasable joint and one connection is a pivoted joint. In the second embodiment, two pivoted joints on each vertical rod are allowed to moved towards and away from each other by means of an expanding and contracting rod.

Both of these constructions permit the chair to be collapsed into a compact linear storage configuration in which the diagonally crossed rods pivot into a position alongside one another while the vertical rods assume a position alongside the diagonal rods. The first embodiment may be converted from the seating position to the compact storage position simply by removing the seat, detaching the four detachable joints, and by gathering the rods into a linear shape. The second embodiment can be converted from the operable seating position to the compact storage position by unlocking a seat brace which allows the four extending rods to extend, and by moving opposing vertical rods towards each other. In both embodiments, the chair can also be constructed without bracing rods incorporated in the seat panel and the flexible seat simply supported at four corners where the upper ends of the diagonal rods meet the vertical rods. This eliminates the need for removing the seat panel while collapsing the chair as the seat panel is simply moved out of the way of the collapsing rods.

The result is a folding chair that is easily opened and closed, has a minimum of parts and joints for the function provided, is safe and sturdy in operation, provides a comfortable mood when a person is seated in the chair, and folds into a compact configuration for storage. These and other objects and advantages of the present invention will appear hereinafter as this disclosure progresses, reference being had to the accompanying drawings.

DESCRIPTION OF THE PREFERRED EMBODIMENTS

Figures 5, 6, 9:
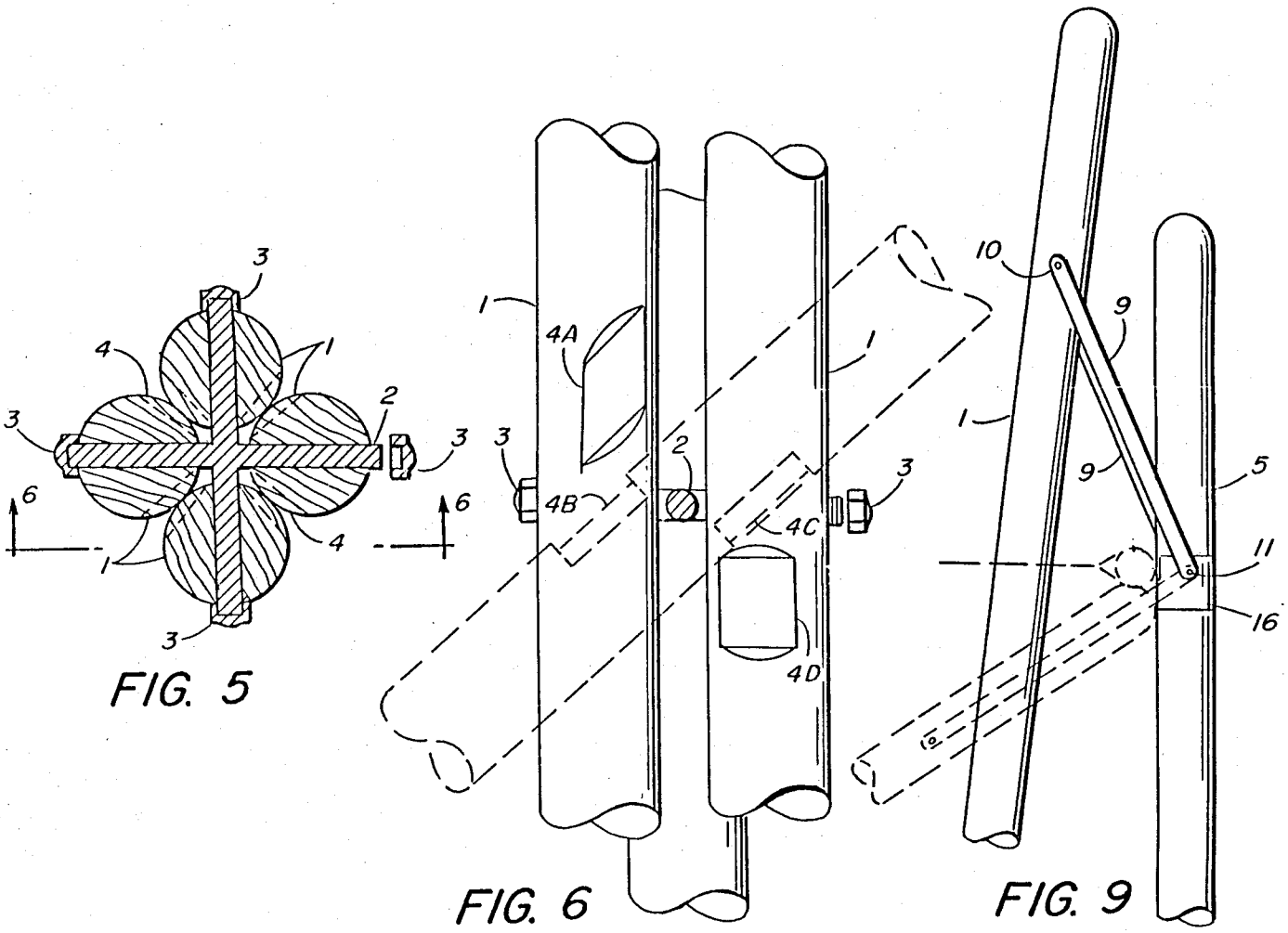
FIG. 5 is a sectional view taken through the pivoted joint located near the midpoints of the diagonal rods taken generally along the line 5—5 in FIG. 4.
FIG. 6 is a sectional view taken generally along the line 6—6 in FIG. 5 with the rod closest to the viewer dotted for clarity.
FIG. 9 is an elevational view taken through the detachable joints shown in the detached state located by circle 9 in FIG. 4.
Figure 8:
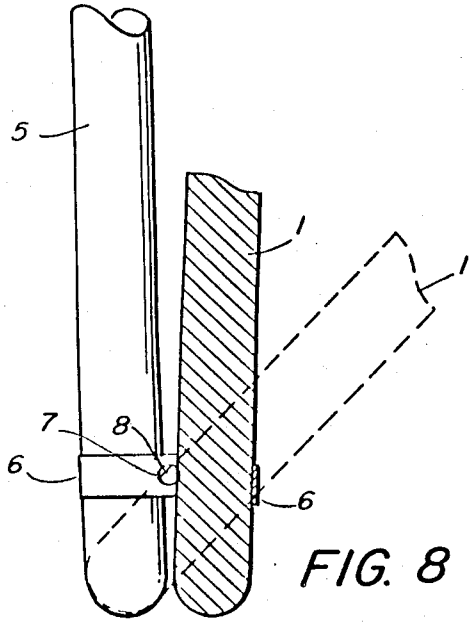
FIG. 8 is an elevational view through the same pivoting lower joint shown in FIG. 7 while the chair is in the collapsed position.
Figure 7:
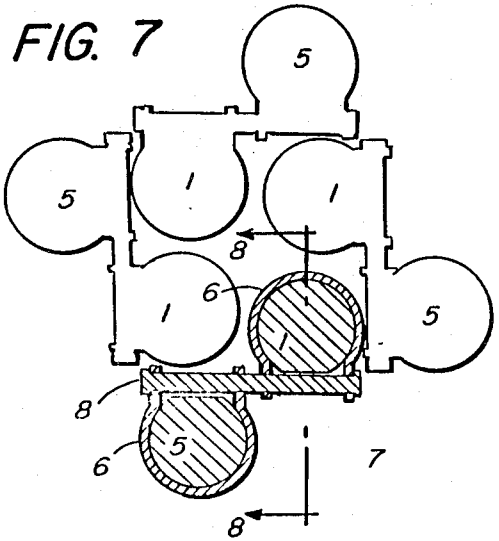
FIG. 7 is a sectional view taken through one of the pivoting lower joints generally along the line 7—7 in FIG. 4.

The folding chair provided by the first embodiments includes four diagonally crossed rods (1) each pivotly connected to one of four pins radiating planarly from a center connector (2) shown in FIG. 5 and secured by bolts (3). Two slots (4) in each diagonal rod allow the rods to interlock with adjacent diagonal rods when the chair is in the operable seating position. When in the seating position, slot **4*a* fits into slot 4*b* and slot 4*c* fits into slot 4*d*. The lower end of each diagonal rod (1) is connected pivotly to each of four vertical rods (5) which define the corners of the chair. The lower joint connecting these two rods is a pivoting connection (FIGS. 7, 8) consisting of two U-shaped attachments (6) each including two holes (7) for the insertion of a bolt (8)** or other fastener which joins the two rods. The vertical and diagonal rods lie diagonally opposed on opposite sides of the bolt. This arrangement allows the vertical rod to move away from the diagonal rod's path of travel when the chair is being collapsed into the storage position thus allowing the chair to assume a more compact configuration when closed. FIG. 8 shows the joint with the chair in the storage position. The dotted line in FIG. 8 shows the location of the diagonal rod when the chair is in the seating position. The upper end of each diagonally crossed rod (1) is connected to the upper portion of the respective vertical rod by means of a releasable joint (FIG. 9). This joint includes two bars (9), each attached pivotly at one end to opposite sides of the diagonal rod (1) at a point between the end of the rod and the center connector (2) using a bolt (10) or other fastener. The other ends of the bars (9) are attached with a bolt (11) or other fastener to opposite sides of the vertical rod (5) at a point where vertical and diagonal rods meet while in the seating position. This configuration allows the end of the diagonal rod to lift away from the vertical rod while being collapsed, and also holds the diagonal rod in place against the vertical rod while the chair is in the seating position.

Figure 1:
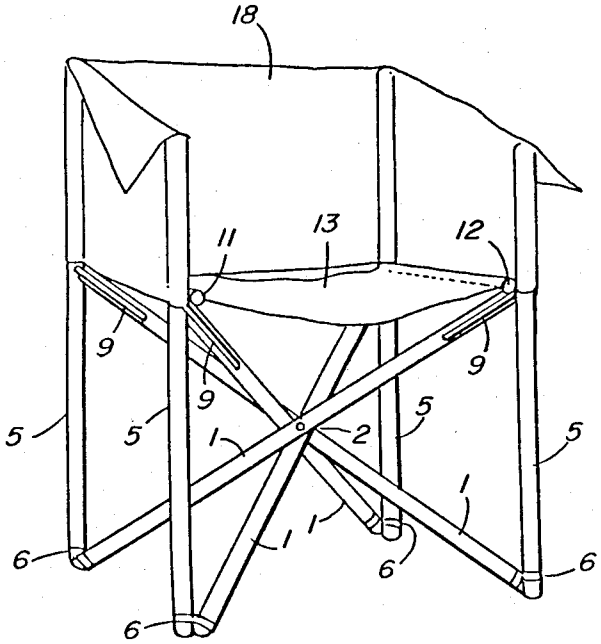
FIG. 1 is a perspective view of the chair made in accordance with the first embodiment, the view being taken generally from the front.
Figure 4:
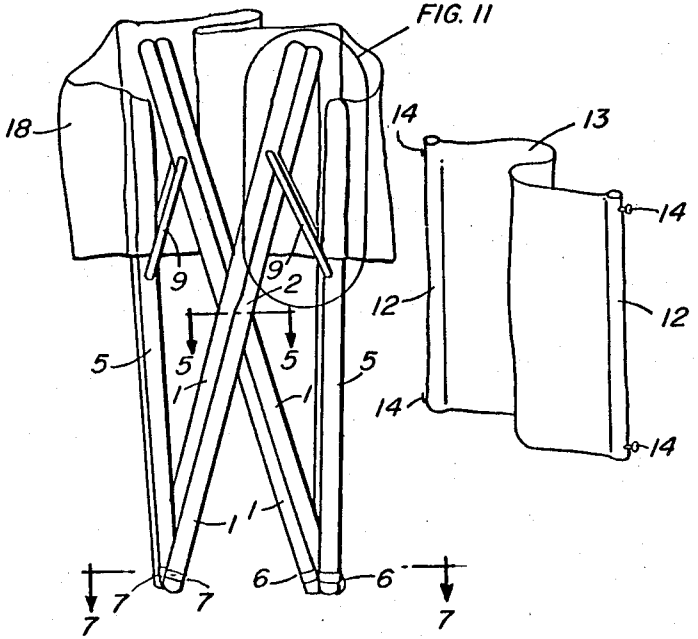
FIG. 4 is a front elevational view of the chair shown in FIG. 1 showing the seat removed, the detachable joints detached, the diagonally crossed rods pivoting towards a parallel shape, the vertical rods moving towards each other, the entire chair assuming a linear configuration.
Figure 3:
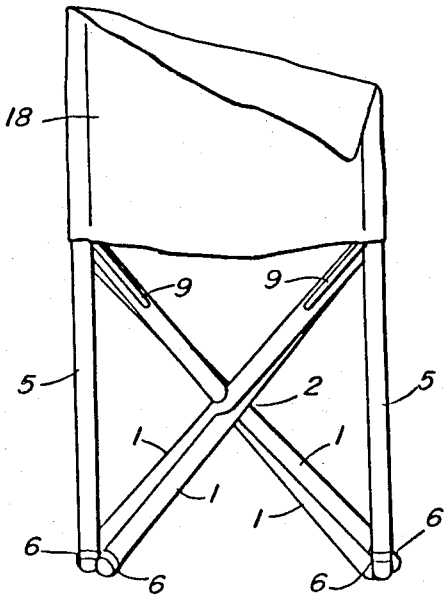
FIG. 3 is a side view of the same.

A flexible seat assembly consists of two rods (12), each inserted into loops formed on opposite edges of a flexible seat panel (13). Each rod includes two screws (14) extending perpendicularly from the rod at either end. Each screw inserts into slot located on each of the vertical rods (FIG. 14), the slot consisting of a depression in the vertical rod (15), a slotted cover plate (16) and a spring clip (17) to hold a screw (14) firmly in place. The seat assembly, when in place, keeps the diagonal rods firmly attached to the vertical rod thus locking the chair in the operable seating position. The chair may also be constructed without bracing rods incorporated in the seat panel and the flexible seat is simply supported at four corners where the upper ends of the diagonal rods meet the vertical rods. This eliminates the need for removing the seat panel in collapsing the chair. As shown in FIGS. 1, 3, the vertical rods extend upward vertically beyond the seat and form supports for flexible armrests and a seatback (18). These vertical rods may or may not extend upwards vertically past the seat. An armless backless stool is formed if none of the vertical rods extend vertically past the seat. A chair with a back and no arms is formed if only two vertical rods extend upwards past the seat. The chair may also be constructed with a pivoting panel backrest (FIG. 13) which is pivoted on pegs (26) extending through the pivoting backrest rods (27) and between vertical rods (5). A flexible material backrest (28) is swung between said support rods.

Figure 2:
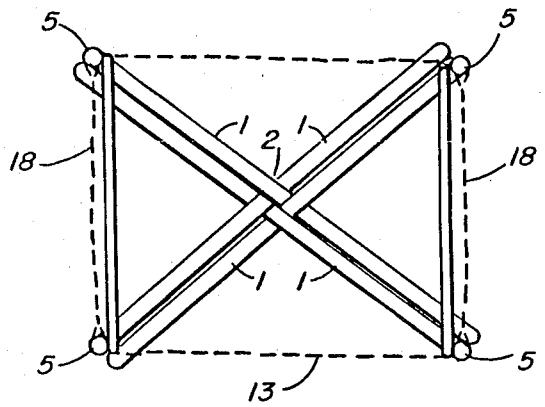
FIG. 2 is a plan view of the same.

The folding chair can easily be collapsed from the operable seating position shown in FIGS. 1, 2, and 3 to the compact storage position with all rods lying alongside one another simply by removing the seat assembly, detaching the four joints between the upper ends of the diagonal rods and the vertical rods and by gathering all the rods into a linear shape. The seat assembly of the chair can be used to wrap and secure the rods in a compact linear configuration.

Figure 11:
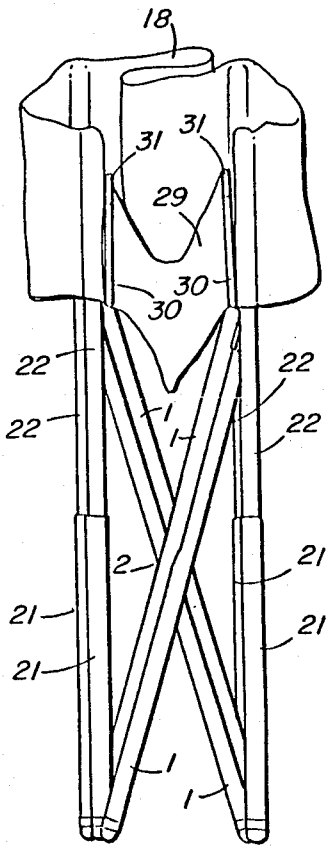
FIG. 11 is a front elevational view of the chair shown in FIG. 10 with the translated position, the crossed rods pivoting towards a parallel shape, the vertical rods moving towards one another, the entire chair assuming a linear configuration.
Figure 12:
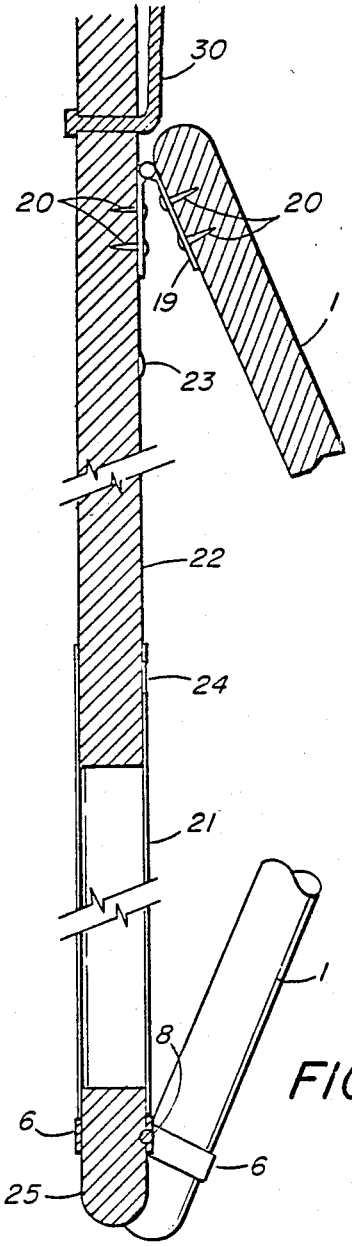
FIG. 12 is a sectional view of the vertical rod shown in FIG. 11, taken through the center of the rod.

The folding chair provided by the second embodiment (FIGS. 10, 11, and 12) includes four diagonally crossed rods (1) each pivotly connected to one of our pins radiating planarly from a center connector (2) shown in FIG. 5 and secured by bolts (3). Two slots (4) in each diagonal rod allow the rods to interlock with adjacent diagonal rods when the chair is in the operable seating position. The lower end of each diagonal rod is connected pivotly to each of four vertical rods (5) (FIGS. 7, 8, and 12) which define the corners of the chair. The joints connecting these two rods is a pivoting connection (FIGS. 7 and 8) consisting of two U-shaped attachments (6) each including two holes (7) for the insertion of a bolt (8) or other fastener which joins the two rods. The vertical and diagonal rods lie diagonally opposed on opposite sides of the bolt. This arrangement allows the vertical rod to move away from the diagonal rod's path of travel when the chair is being collapsed into the storage position thus allowing the chair to assume a more compact configuration when closed. FIG. 8 shows the joint with the chair in the collapsed position. The dotted line in FIG. 8 shows the location of the diagonal rod when the chair is in the seating position. The upper end of the diagonally crossed rod (1) is connected to the upper portion of the respective vertical rod by a hinged joint (FIG. 12) consisting of a hinge (19) connected to respective vertical and diagonal rods with screws (20) or other fasteners. Each of the four vertical rods includes a means of extension whereby the said two joints on each vertical rod are allowed to translate away from each other to facilitate collapsing of the chair. This means of extension includes a lower vertical rod (25) which connects to the diagonally crossed rod by said pivoting joint. This lower vertical rod is firmly secured to a hollow extension tube (21) which is allowed to slide along an upper vertical rod (22). FIG. 12 shows the vertical rod assembly in the extended storage position. When the chair is in the operable seating position, the upper vertical rod meets the lower vertical rod and the rods are locked in this position by a spring clip (23) attached to the vertical upper rod which fits into a slot (24) formed on the hollow extension tube.

Figure 15:
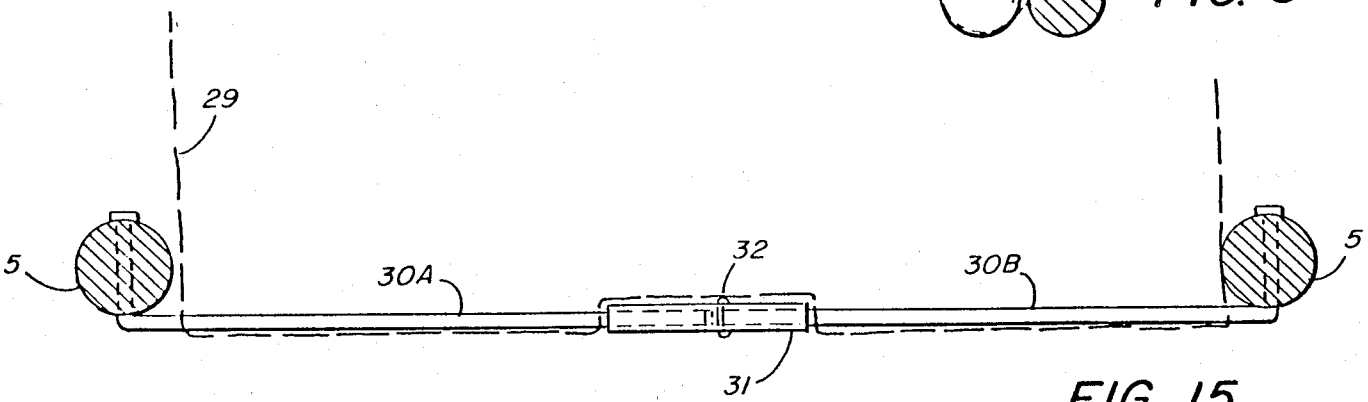
FIG. 15 is a plan view of a folding seat brace described in the second embodiment.
Figure 16:
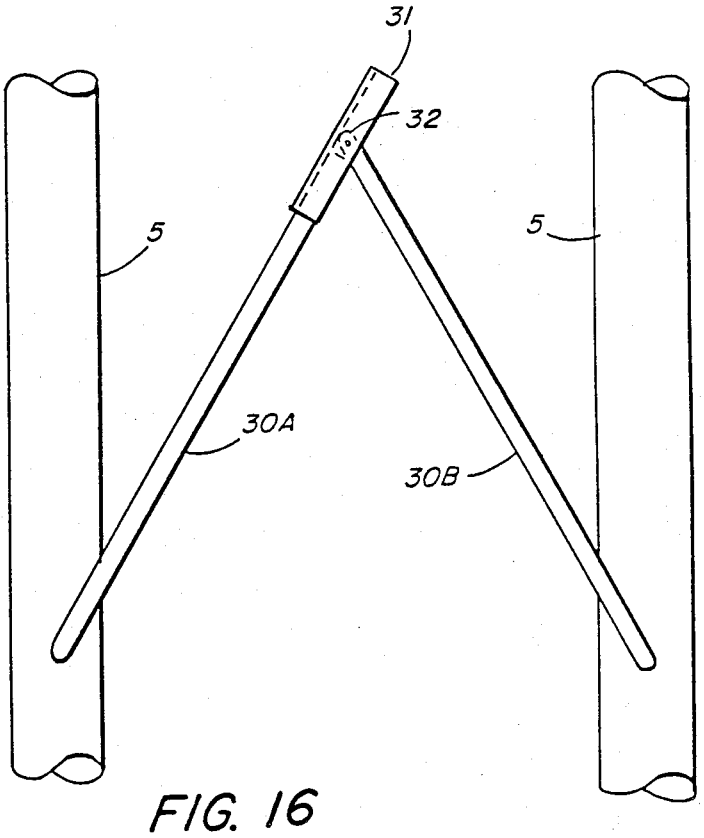
FIG. 16 is an elevational view of the folding seat brace described in FIG. 15.

In the second embodiment, a flexible seat assembly (FIGS. 15, 16) incorporates folding rods at either end which serve to brace the chair while in the seating position. The plan view (FIG. 15) shows the seat assembly while the chair is in the seating position, the elevational view (FIG. 16) shows the seat assembly while the chair is being folded to a storage position. More specifically, this seat assembly consists of a flexible material seat (29) which is swung between 2 rods, each rod consisting of 3 parts. The parts are the two pieces of rod (30A and 30B) and a connector (31). Both pieces of the seat bracing rod (30A and 30B) are bent at one end to insert into the vertical rod (5). The connector joint (31) is rigidly attached to one piece of the seat bracing rod (30A) and pivotly attached to the other piece of the seat bracing rod (30B) by a pin (32). This configuration allows for a bracing rod to be incorporated into the seat assembly without the need for removing the assembly from the chair. The chair may also be constructed without bracing rods incorporated in the seat panel and the flexible seat is simply supported at the four corners where the upper ends of the diagonal rods meet the vertical rods. This eliminates the need for removing the seat panel in collapsing the chair.

Figure 10:
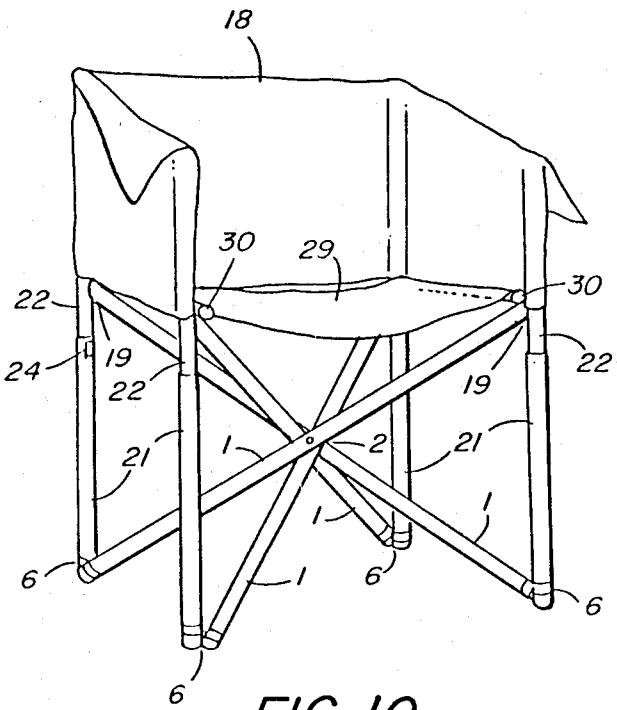
FIG. 10 is a perspective view of a chair made in accordance with the second embodiment, the view taken generally from the front.

As shown in FIG. 10, the vertical rods extend upward vertically beyond the seat and form support for flexible armrests and a seatback (18). These vertical rods may or may not extend upward vertically past the seat. An armless backless stool is formed if none of the vertical rods extend vertically past the seat. A chair with a back and no arms is formed if only two vertical rods extend upward past the seat. The chair may also be constructed with a pivoting panel backrest which is pivoted on pegs (26) extending through the pivoting backrest rods (27) and the vertical rods (5). A flexible material backrest (28) is swung between said support rods.

Figure 13:
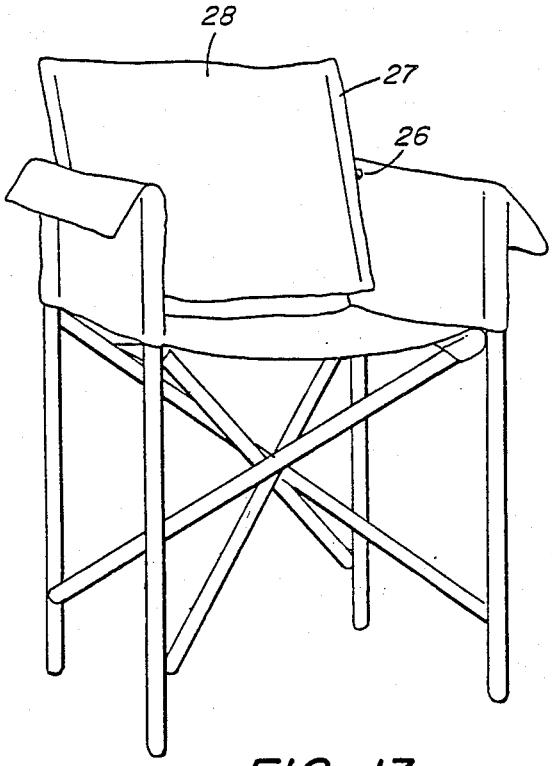
FIG. 13 is a perspective view of the chair with a pivoting panel backrest and extended legs.
Figure 14:
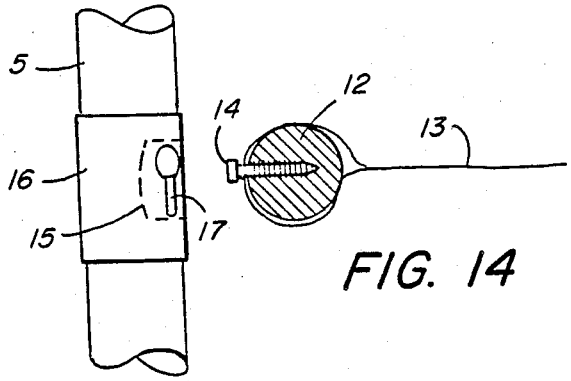
FIG. 14 is a sectional view of a removable seat brace connection described in the first embodiment.

As shown in FIG. 13, the vertical rods (5) may extend downward beyond the lower joint connecting vertical rods to form elongated legs for the chair.

The chair may also be constructed with diagonal rods which contract to facilitate folding into the compact storage position. In this case, the chair would be collapsed from the operable seating position to the compact storage position by contracting the length of the diagonal rods.

The folding chair provided by the second embodiment can be easily collapsed from the operable seating position shown in FIG. 10 to the compact storage position with all the rods lying alongside one another simply by bending the braces of the seat assembly and by moving the vertical rod assemblies towards one another.

I claim:

1. A chair structure comprised of eight rods, four of which stand upright a distance apart, and four rods which cross diagonally and are secured to each other at or near their midpoints, the lower portion of each diagonal rod being connected to a lower portion of an upright rod, the upper portion of each diagonal rod being connected to the upper portion of the upright rod loacted at the corner diagonally opposite the first upright rod, a flexible seat member suspended between the four upright rods, the connection located at the crossing of the diagonal members including a joint allowing the four diagonal rods to pivot into a near parallel configuration with the diagonal rods lying near parallel to one another and the connections between upright rods and diagonal rods including a pivoting joint allowing the diagonal rod to pivot into a position near parallel to the upright rod, said pivoting joint working in conjunction with said connection at the crossing of the diagonal members to allow the structure to be collapsed into a linear configuration.

2. The chair structure set forth in claim 1 further characterized in that the upright rods extend upwards past the level of the seat forming supports for flexible backrest and armrest members which do not require removal during collapsing of the structure.

3. The chair structure set forth in claim 1 further characterized by the addition of bracing members between adjacent diagonal or upright members, said braces being used to increase rigidity.

4. The chair structure set forth in claim 3 further characterized in that said bracing member is also used to support a flexible seat panel.

5. The chair structure set forth in claim 1 further characterized in that the joints connecting upright rods to diagonal rods include a detachable joint.

6. The chair structure set forth in claim 5 further characterized in that said detachable joint includes a bar pivotly connected between upright and diagonal rods which determines the location of the resting point of the diagonal rod on the upright rod when the chair is in the seating position.

7. A chair comprised of eight rods, four rods which stand upright a distance apart and four rods which cross diagonally and are secured to one another at or near their midpoints, the lower portion of each diagonal rod being connected to a lower portion of an upright rod, the upper portion of each diagonal rod being connected to the upper portion of the upright rod located at the corner diagonally opposite the first upright rod, the connection located at the crossing of the diagonal rods including a joint allowing the four diagonal rods to pivot into a near parallel configuration with said diagonal rods lying adjacent one another and the connections between upright rods and diagonal rods including a pivoting joint allowing the diagonal rod to pivot into a position near parallel to the upright rod and said pivoting joint works in conjunction with a translating joint assembly which allows a pivoted joint at the connection of upright and diagonal rods to move towards or away from either the other joint located on the upright rod or the joint at the crossing of the diagonal rods to facilitate collapsing of the structure.

8. The structure set forth in claim 7 further characterized in that the translating joint assembly includes an extension tube which is allowed to slide along the axis of an upright or diagonal rod.

9. A chair structure comprised of eight rods, four rods which stand upright a distance apart and four rods which cross diagonally and are secured to each other at or near their midpoints, the lower portion of each diagonal rod being connected to the lower portion of an upright rod, the upper portion of each diagonal rod being connected to the upper portion of the upright rod located at the corner diagonally opposite the first upright rod, and a connection between upright and diagonal rods including a pivoting joint which allows the vertical rod to move out of the diagonal rod's path of travel when the chair is being collapsed into the storage position and said means includes a bolt or peg fastened pivotally to one rod and fastened pivotally or fixedly to the other rod in a diagonally off-set configuration with the rods connected to opposite ends of the bolt.

10. A structure comprised of eight rods, four which stand upright a distance apart and four rods which cross diagonally and are secured to each other at or near their midpoints, the lower portion of each diagonal rod being connected to a lower portion of an upright rod, the upper portion of each diagonal rod being connected to the upper portion of the upright rod located at the corner diagonally opposite the first upright rod, the connection located at the crossing of the diagonal members including a joint allowing the four diagonal rods to pivot into a near parallel configuration with diagonal rods lying near parallel to one another and the connections between upright rods and diagonal rods including a pivoting joint allowing the diagonal rod to pivot into a position near parallel to the upright rod, said pivoting joints working in conjunction with the joint located at the crossing of diagonal rods to allow the structure to be collapsed into a linear configuration.

* * * * *